US009842534B2

(12) United States Patent
Kim

(10) Patent No.: US 9,842,534 B2
(45) Date of Patent: Dec. 12, 2017

(54) DISPLAY DEVICE AND DISPLAY SYSTEM INCLUDING THE SAME

(71) Applicant: SAMSUNG DISPLAY CO., LTD., Yongin, Gyeonggi-Do (KR)

(72) Inventor: Dong-Gyu Kim, Yongin-si (KR)

(73) Assignee: Samsung Display Co., Ltd., Yongin, Gyeonggi-do (KR)

( * ) Notice: Subject to any disclaimer, the term of this patent is extended or adjusted under 35 U.S.C. 154(b) by 162 days.

(21) Appl. No.: 14/607,275

(22) Filed: Jan. 28, 2015

(65) Prior Publication Data

US 2016/0078803 A1 Mar. 17, 2016

(30) Foreign Application Priority Data

Sep. 15, 2014 (KR) ..... 10-2014-0121805

(51) Int. Cl.
*G09G 3/30* (2006.01)
*G09G 3/3208* (2016.01)
*G09G 3/00* (2006.01)

(52) U.S. Cl.
CPC ..... *G09G 3/3208* (2013.01); *G09G 3/007* (2013.01); *G09G 2300/0413* (2013.01); *G09G 2320/0257* (2013.01); *G09G 2320/043* (2013.01); *G09G 2340/0464* (2013.01)

(58) Field of Classification Search
CPC .. G09G 5/02; G09G 5/10; G09G 5/00; G09G 3/30; G09G 3/32; G09G 3/34; G09G 3/36
See application file for complete search history.

(56) References Cited

U.S. PATENT DOCUMENTS

2002/0027612 A1* 3/2002 Brill ..... G06T 1/0071 348/473
2006/0187158 A1* 8/2006 Wakabayashi ..... G06F 3/1446 345/87
2010/0158136 A1* 6/2010 Peng ..... H04N 19/176 375/240.27
2014/0063069 A1* 3/2014 Prabakaran ..... G09G 5/00 345/660
2015/0049217 A1* 2/2015 Takahashi ..... H04N 5/2621 348/231.99
2015/0077406 A1* 3/2015 Lee ..... G09G 3/3648 345/204

FOREIGN PATENT DOCUMENTS

KR 10-2005-0048300 A 5/2005
KR 10-2006-0116529 A 11/2006
KR 10-2009-0071683 A 7/2009
KR 10-2012-0019016 A 3/2012

* cited by examiner

*Primary Examiner* — Pegeman Karimi
(74) *Attorney, Agent, or Firm* — Lee & Morse, P.C.

(57) ABSTRACT

A display device includes a controller, an image processor, and a pixel array. The controller generates an image control signal and a position control signal. The image processor generates a frame image based on an image signal and the image control signal. The position control signal includes position information where the frame image is located. The pixel array includes base pixels and addition pixels. The pixel array displays the frame image in the base pixels and the addition pixels based on the position control signal. A number of the base pixels corresponds to a resolution of the frame image. The addition pixels are different from the base pixels.

19 Claims, 19 Drawing Sheets

DISPLAY DEVICE AND DISPLAY SYSTEM INCLUDING THE SAME

CROSS REFERENCE TO RELATED APPLICATION

Korean Patent Application No. 10-2014-0121805, filed on Sep. 15, 2014, and entitled, "Display Device and Display System Including the Same," is incorporated by reference herein in its entirety.

BACKGROUND

1. Field

One or more embodiments described herein relate to a display device and a display system including the display device.

2. Description of the Related Art

As the radiation time of an organic light-emitting diode increases, its luminous efficiency may decrease. Also, the more an organic light-emitting diode is used, the more likely an after-image effect may be generated in a display panel.

SUMMARY

In accordance with one embodiment, a display device includes a controller to generate an image control signal and a position control signal; an image processor to generate a frame image based on an image signal and the image control signal, and to provide the frame image and the position control signal, the position control signal including a position information where the frame image is located; and a pixel array including base pixels and addition pixels, the pixel array to display the frame image in the base pixels and the addition pixels based on the position control signal, wherein a number of the base pixels corresponds to a resolution of the frame image and wherein the addition pixels are different from the base pixels.

The addition pixels may be at first to fourth sides of the base pixels. A number of first direction addition pixels added to the first side according to a first direction may be equal to a number of a third direction addition pixels added to the third side according to a third direction, and a number of a second direction addition pixels added to the second side according to a second direction may be equal to a number of a fourth direction addition pixels added to the fourth side according to a fourth direction.

A proportion of the number of the first direction addition pixels and the number of the second direction addition pixels may be 16:9. A number of a first direction addition pixels added to the first side according to a first direction may be different from a number of a third direction addition pixels added to the third side according to a third direction, and a number of a second direction addition pixels added to the second side according to a second direction may be different from a number of a fourth direction addition pixels added to the fourth side according to a fourth direction.

A proportion of a first addition pixel sum and a second addition pixel sum may be 16:9, the first addition pixel sum may be a sum of the number of the first direction addition pixels and the number of the third direction addition pixels, and the second addition pixel sum may be a sum of the number of the second direction addition pixels and the number of the fourth direction addition pixels.

The addition pixels may be at one side of a first side or a third side of the base pixels, and the addition pixels may be at one side of a second side or a fourth side of the base pixels. When the addition pixels are at the first side and the second side, a proportion of a number of a first direction addition pixels and a number of a second direction addition pixels may be 16:9, the number of first direction addition pixels may be added to the first side according to a first direction, and the number of a second direction addition pixels may be added to the second side according to a second direction.

A number of the addition pixels may be less than a number of the base pixels. The number of the addition pixels may be less than 3% of the number of the base pixels. The pixel array may display the frame image in a plurality of pixels in the base pixels and the addition pixels, a number of the plurality of pixels may correspond to a resolution of the frame image, and a level value of pixels that do not display the frame image among the base pixels and the addition pixels may be one of a first level value or a second level value. A color corresponding to the first level value may be black, and a color corresponding to the second level value may be gray.

The controller may generate a background control signal, the image processor may output the background control signal, the frame image, and the position control signal, and the pixel array may select one of the first level value or the second level value as the level value of pixels that do not display the frame image, among the base pixels and the addition pixels, based on the background control signal.

The position information may be changed based on a predetermined time interval. The predetermined time interval may be less than three seconds. When the controller provides a first position control signal and provides a second control signal after the predetermined time interval, second position information in the second position control signal may include information corresponding to an adjacent pixel of a pixel indicated by a first position information in the first position control signal.

In accordance with another embodiment, a display system includes a processor to provide an image signal; and a display device to display a frame image generated based on the image signal, the display device including: a controller to generate an image control signal and a position control signal; an image processor to generate a frame image based on an image signal and the image control signal, and to provide the frame image and the position control signal, the position control signal including position information where the frame image is located; and a pixel array including base pixels and addition pixels, the pixel array to display the frame image in the base pixels and the addition pixels based on the position control signal, wherein a number of the base pixels corresponds to a resolution of the frame image and wherein the addition pixels are different from the base pixels.

The position information may be changed every predetermined time interval, and the controller may provide the position control signal to the image processing unit the every predetermined time interval. When the position information in the position control signal is changed, a location where the frame image is displayed in the pixel array may be changed. The addition pixels may be at first to fourth sides of the base pixels, a number of a first direction addition pixels added to the first side according to a first direction may be equal to a number of a third direction addition pixels added to the third side according to a third direction, and a number of a second direction addition pixels added to the second side according to a second direction may be equal to a number of a fourth direction addition pixels added to the fourth side according to a fourth direction.

BRIEF DESCRIPTION OF THE DRAWINGS

Features will become apparent to those of skill in the art by describing in detail exemplary embodiments with reference to the attached drawings in which.

DETAILED DESCRIPTION

Figure 1:
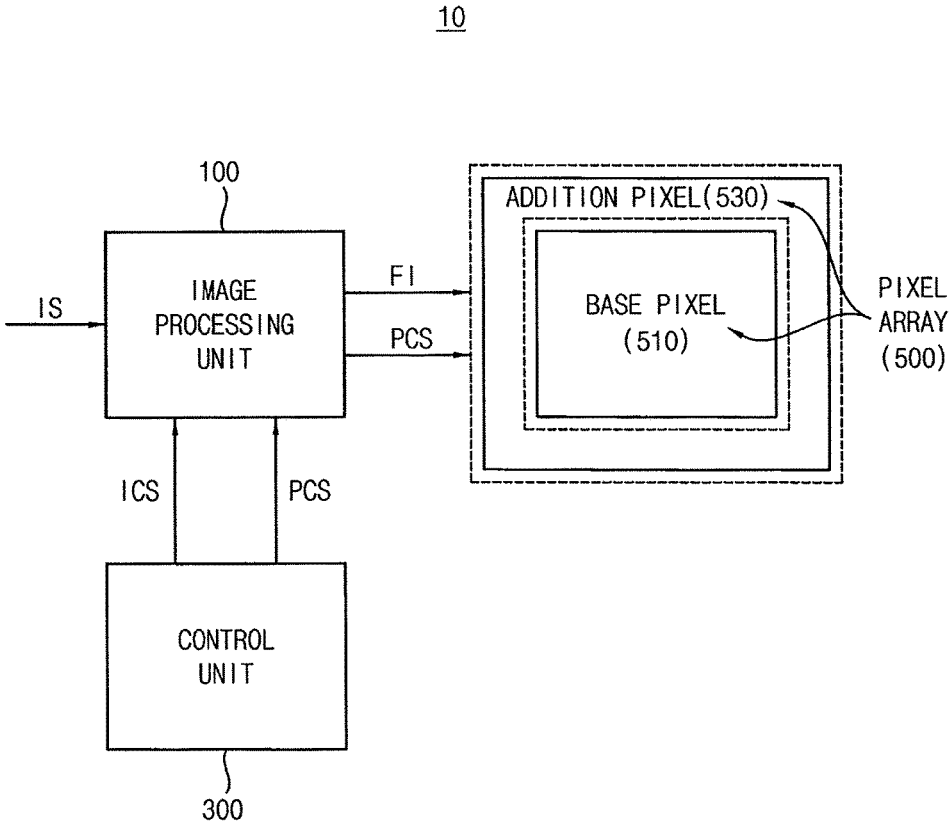
FIG. 1 illustrates an embodiment of a display device.

Example embodiments are described more fully hereinafter with reference to the accompanying drawings; however, they may be embodied in different forms and should not be construed as limited to the embodiments set forth herein. Rather, these embodiments are provided so that this disclosure will be thorough and complete, and will fully convey exemplary implementations to those skilled in the art. In the drawings, the dimensions of layers and regions may be exaggerated for clarity of illustration. Like reference numerals refer to like elements throughout.

Figure 2:
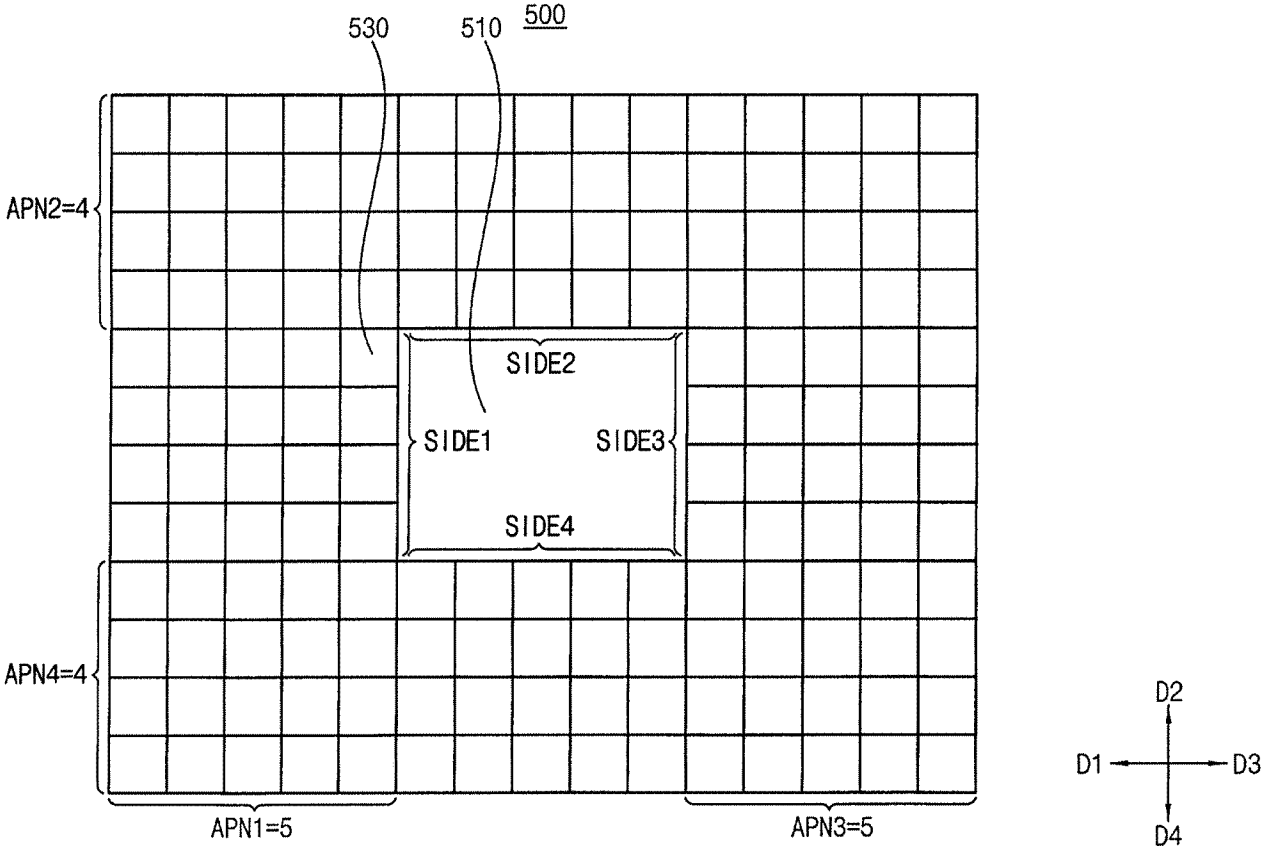
FIG. 2 illustrates an embodiment of a pixel array.

FIG. 1 illustrates an embodiment of a display device 10, and FIG. 2 illustrates an embodiment of a pixel array in the display device 10. Referring to FIGS. 1 and 2, the display device 10 includes a control unit 300, an image processing unit 100, and a pixel array 500. The control unit 300 generates an image control signal ICS and a position control signal PCS. The image control signal ICS may be used to compose a frame image FI from an image signal. The position control signal PCS may be used to determine a position where the frame image FI is displayed in the pixel array 500.

The image processing unit 100 generates a frame image FI based on an image signal IS and the image control signal ICS. The image processing unit 100 provides the frame image FI and the position control signal PCS. The position control signal PCS includes position information PI where the frame image FI is located. For example, at a first time, the image processing unit 100 may provide the first frame image FI1 and the first position control signal PCS1 to the pixel array 500. The first frame image FI1 may be generated based on the image signal IS and the image control signal ICS. The first position control signal PCS1 may include the position information PI where the first frame image FI1 is located.

At a second time after the first time, the image processing unit 100 may provide the second frame image FI2 and the second position control signal PCS2 to the pixel array 500. The second frame image FI2 may be generated based on the image signal IS and the image control signal ICS. The second position control signal PCS2 may include the position information PI where the second frame image FI2 is located. A pixel corresponding to the position information PI in the second position control signal PCS2 may be an adjacent pixel to a pixel corresponding to the position information PI in the first position control signal PCS1.

The pixel array 500 includes base pixels 510 and addition pixels 530. The pixel array 500 displays the frame image FI in the base pixels 510 and the addition pixels 530 based on the position control signal PCS. A number of the base pixels 510 correspond to a resolution of the frame image FI. For example, the resolution of the frame image FI may be 3840*2160. If the frame image FI has this resolution, the number of the base pixels 510 may be 3840*2160. The addition pixels 530 are different from the base pixels 510. The addition pixels 530 may be located at one or more sides of the base pixels 510. In one embodiment, the addition pixels 530 are located at first to fourth sides SIDE1 to SIDE4 of the base pixels 510.

For example, the pixel array 500 may display the first frame image FI1 in the base pixels 510 based on the first position control signal PCS1. The first frame image FI1 may be generated based on the image signal IS and the image control signal ICS. After that, the pixel array 500 may display the second frame image FI2 in pixels that are one pixel-shifted from the base pixels 510 based on the second position control signal PCS2.

The second frame image FI2 may be generated based on the image signal IS and the image control signal ICS. For example, the position information PI in the second position control signal PCS2 may be a first position information PI1. The first position information PI1 may indicate a one pixel-shift according to the first direction D1. The pixel array 500 may display the second frame image FI2 in pixels that are one pixel-shifted from the base pixels 510 according to the first direction D1. In this case, the second frame image FI2 may be displayed in the base pixels 510 and addition pixels 530.

Also, the position information PI in the second position control signal PCS2 may be a second position information PI2. The second position information PI2 may indicate one pixel-shift according to the second direction D2. The pixel array 500 may display the second frame image FI2 in pixels that are one pixel-shifted from the base pixels 510 according to the second direction D2. In this case, the second frame image FI2 may be displayed in the base pixels 510 and the addition pixels 530. In the same manner, the pixel array 500 may display the second frame image FI2 in pixels that are one pixel-shifted from the base pixels 510 according to the third direction D3. Also, the pixel array 500 may display the second frame image FI2 in pixels that are one pixel-shifted from the base pixels 510 according to the fourth direction D4.

In one embodiment, a number APN1 of a first direction addition pixels added to the first side SIDE1 according to a first direction D1 may be equal to a number APN3 of a third direction addition pixels added to the third side SIDE3 according to a third direction D3. A number APN2 of a second direction addition pixels added to the second side SIDE2 according to a second direction D2 may be equal to a number APN4 of a fourth direction addition pixels added to the fourth side SIDE4 according to a fourth direction D4.

For example, the number APN1 of the first direction addition pixels added to the first side SIDE1 according to the first direction D1 may be 5. The number APN3 of the third direction addition pixels added to the third side SIDE3 according to the third direction D3 may be 5. In this case, the number APN1 of the first direction addition pixels and the number APN3 of the third direction addition pixels may be the same number 5.

The number APN2 of the second direction addition pixels added to the second side SIDE2 according to the second direction D2 may be 4. The number APN4 of the fourth direction addition pixels added to the fourth side SIDE4 according to the fourth direction D4 may be 4. In this case, the number APN2 of the second direction addition pixels and the number APN4 of the fourth direction addition pixels may be the same number 4. In case the addition pixels 530 are located in a first to fourth side SIDE1 to SIDE4 of the base pixels 510, the number APN1 of the first direction addition pixels and the number APN3 of the third direction addition pixels may be equal. The number APN2 of the second direction addition pixels and the number APN4 of the fourth direction addition pixels may be equal.

In accordance with the present embodiment, changing where the frame image FI is displayed using the addition pixels 530 in the display device 10 may reduce or prevent distortion of the frame image FI because the resolution of the frame image FI is maintained. Also, changing the position where the frame image FI is displayed using the addition pixels 530 may reduce or prevent an after-image effect.

Figure 3:
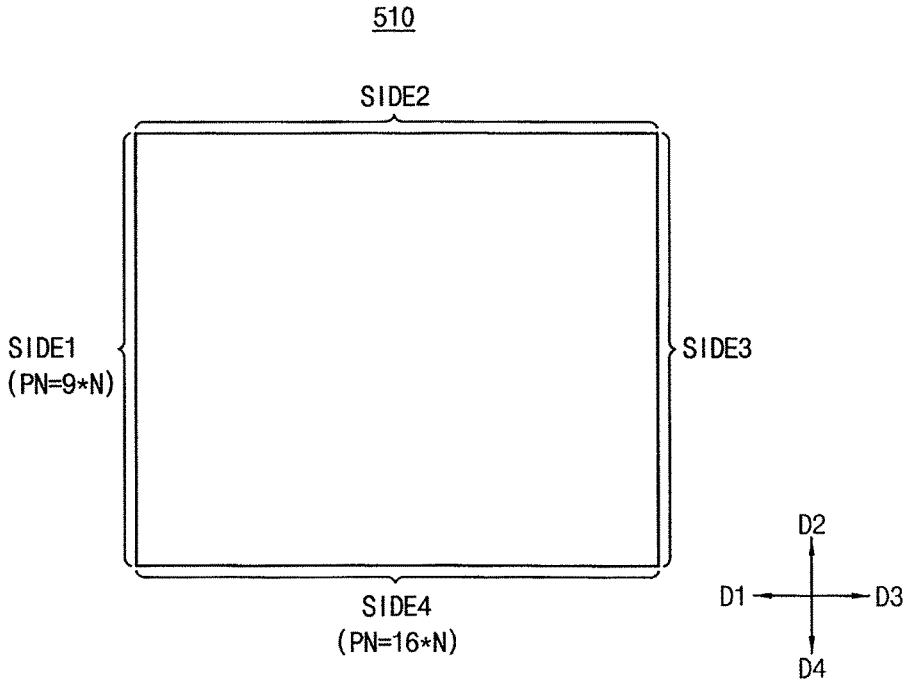
FIG. 3 illustrates an embodiment of base pixels in the pixel array.
Figure 4:
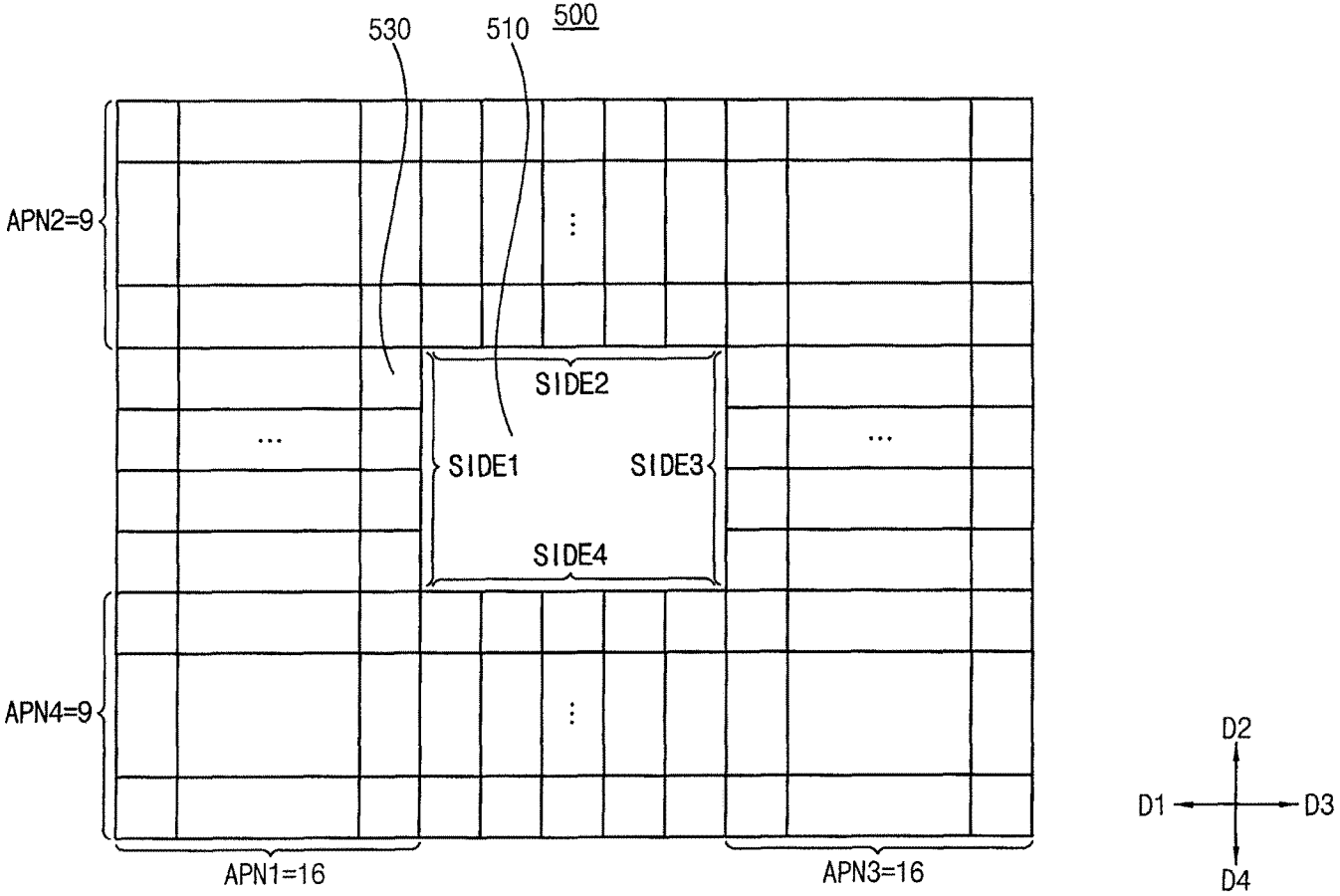
FIG. 4 illustrates an embodiment of addition pixels in the pixel array.

FIG. 3 illustrates an embodiment of base pixels in the pixel array 500 of FIG. 2, and FIG. 4 illustrates addition pixels 530 in the pixel array 500 of FIG. 2 according to one embodiment.

Referring to FIGS. 3 and 4, the pixel array 500 may include the base pixels 510 and the addition pixels 530. The number of the base pixels 510 may correspond to the resolution of the frame image FI. For example, the resolution of the frame image FI may be 3840*2160. In this case, the number of the base pixels 510 may be 3840*2160. The addition pixels 530 are different from the base pixels 510. The addition pixels 530 may be located at one or more sides of the base pixels 510. In one embodiment, the additional pixels 530 are located at first to fourth sides SIDE1 to SIDE4 of the base pixels 510.

For example, the number of pixels corresponding to the first side SIDE1 of the base pixels 510 may be 9*N. The number of pixels corresponding to the fourth side SIDE4 of the base pixels 510 may be 16*N. The proportion of the number of pixels corresponding to the first side SIDE1 of the base pixels 510 and the number of pixels corresponding to the fourth side SIDE4 of the base pixels 510 may be 16:9. In this case, the proportion of the number APN1 of the first direction addition pixels and the number APN2 of the second direction addition pixels may be 16:9.

For example, the number APN1 of the first direction addition pixels may be 16. The number APN2 of the second direction addition pixels may be 9. If the proportion of the number APN1 of the first direction addition pixels and the number APN2 of the second direction addition pixels is 16:9, in the case where the frame image FI is extended in pixel array 500, distortion of the frame image FI may be reduced or prevented because the proportion of the frame image FI that is 16:9 is maintained.

Figure 5:
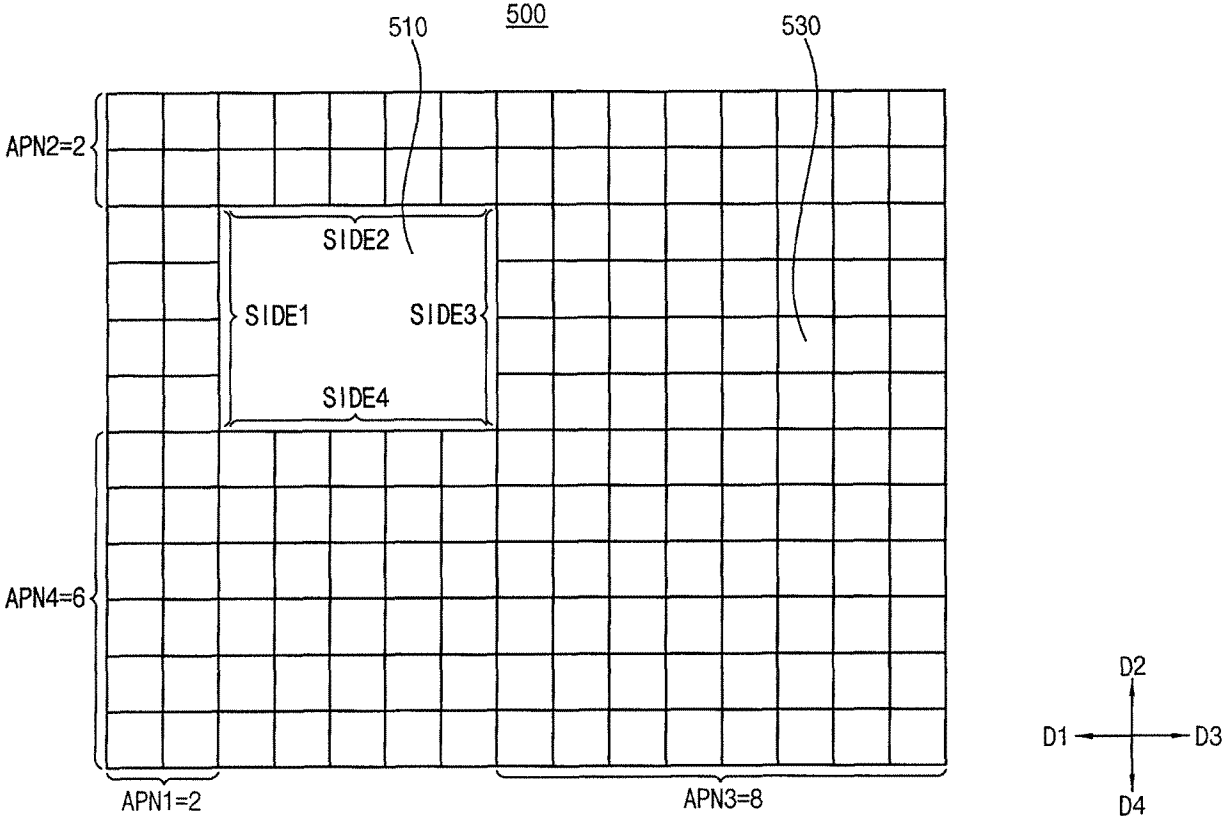
FIG. 5 illustrates another embodiment of a pixel array.

FIG. 5 illustrates another embodiment of a pixel array 500 in the display device of FIG. 1. Referring to FIG. 5, the pixel array 500 may include the base pixels 510 and the addition pixels 530. A number APN1 of a first direction addition pixels added to the first side SIDE1 according to a first direction D1 may be different from a number APN3 of a third direction addition pixels added to the third side SIDE3 according to a third direction D3. For example, the number APN1 of the first direction addition pixels may be 2. The number APN3 of the third direction addition pixels may be 8. The base pixels 510 may not be located in the center of the pixel array 500. In case the base pixels 510 are not located in the center of the pixel array 500, the number APN1 of the first direction addition pixels added to the first side SIDE1 according to the first direction D1 may be different from the number APN3 of the third direction addition pixels added to the third side SIDE3 according to the third direction D3.

A number APN2 of a second direction addition pixels added to the second side SIDE2 according to a second direction D2 may be different from a number APN4 of a fourth direction addition pixels added to the fourth side SIDE4 according to a fourth direction D4. For example, the number APN2 of the second direction addition pixels may be 2. The number APN4 of the fourth direction addition pixels may be 6. The base pixels 510 may not be located in the center of the pixel array 500. In case the base pixels 510 are not located in the center of the pixel array 500, the number APN2 of the second direction addition pixels added to the second side SIDE2 according to the second direction D2 may be different from the number APN4 of the fourth direction addition pixels added to the fourth side SIDE4 according to the fourth direction D4.

Figure 6:
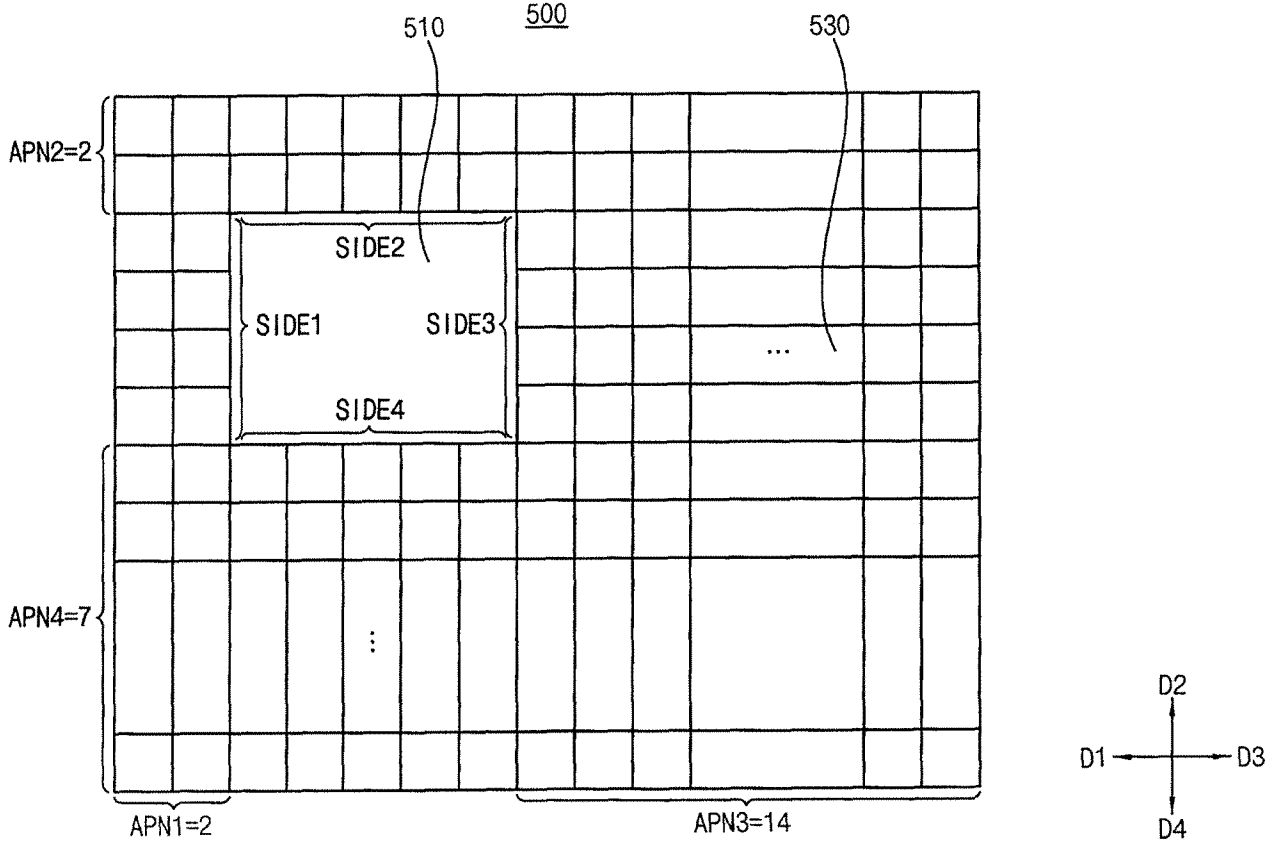
FIG. 6 illustrates another embodiment of addition pixels.

FIG. 6 illustrates an embodiment of addition pixels in the pixel array 500 of FIG. 5. Referring to FIG. 6, the pixel array 500 includes the base pixels 510 and the addition pixels 530. The number of pixels corresponding to the first side SIDE1 of the base pixels 510 are 9*N. The number of pixels corresponding to the fourth side SIDE4 of the base pixels 510 are 16*N.

The proportion of the number of pixels corresponding to the first side SIDE1 of the base pixels 510 and the number of pixels corresponding to the fourth side SIDE4 of the base pixels 510 may be 16:9. In this case, the proportion of a first addition pixel sum and a second addition pixel sum may be 16:9. The first addition pixel sum may be a sum of the number APN1 of the first direction addition pixels and the number APN3 of the third direction addition pixels. The second addition pixel sum may be a sum of the number APN2 of the second direction addition pixels and the number APN4 of the fourth direction addition pixels.

For example, the number APN1 of the first direction addition pixels may be 2. The number APN3 of the third direction addition pixels may be 14. The first addition pixel sum may be 16. The number APN2 of the second direction addition pixels may be 2. The number APN4 of the fourth direction addition pixels may be 7. The second addition pixel sum may be 9. The proportion of the first addition pixel sum and the second addition pixel sum may be 16:9. If the proportion of the first addition pixel sum and the second addition pixel sum is 16:9, in case the frame image FI is extended in pixel array 500, the distortion of the frame image FI may be reduced or prevented because the proportion of the frame image FI that is 16:9 is maintained.

Figure 7:
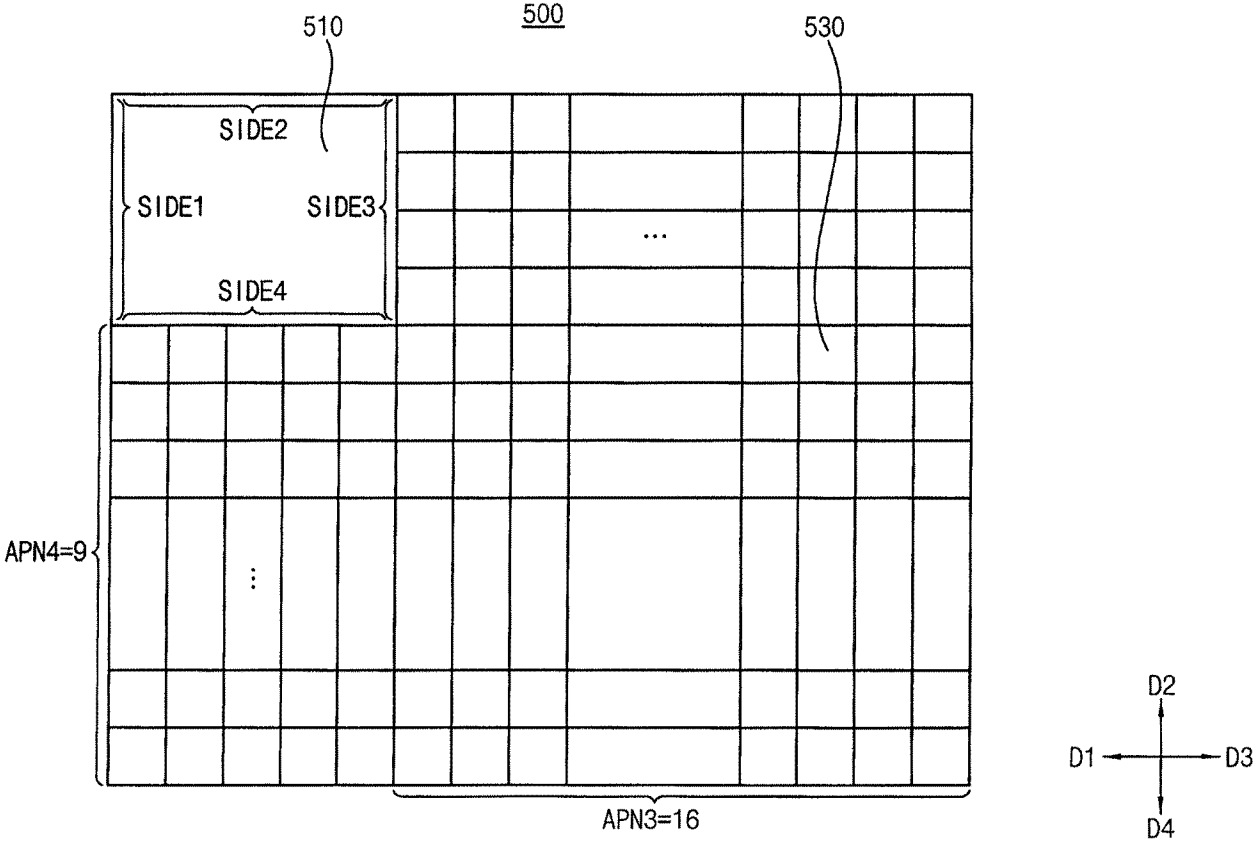
FIGS. 7 and 8 illustrate additional embodiments of a pixel array.
Figure 8:
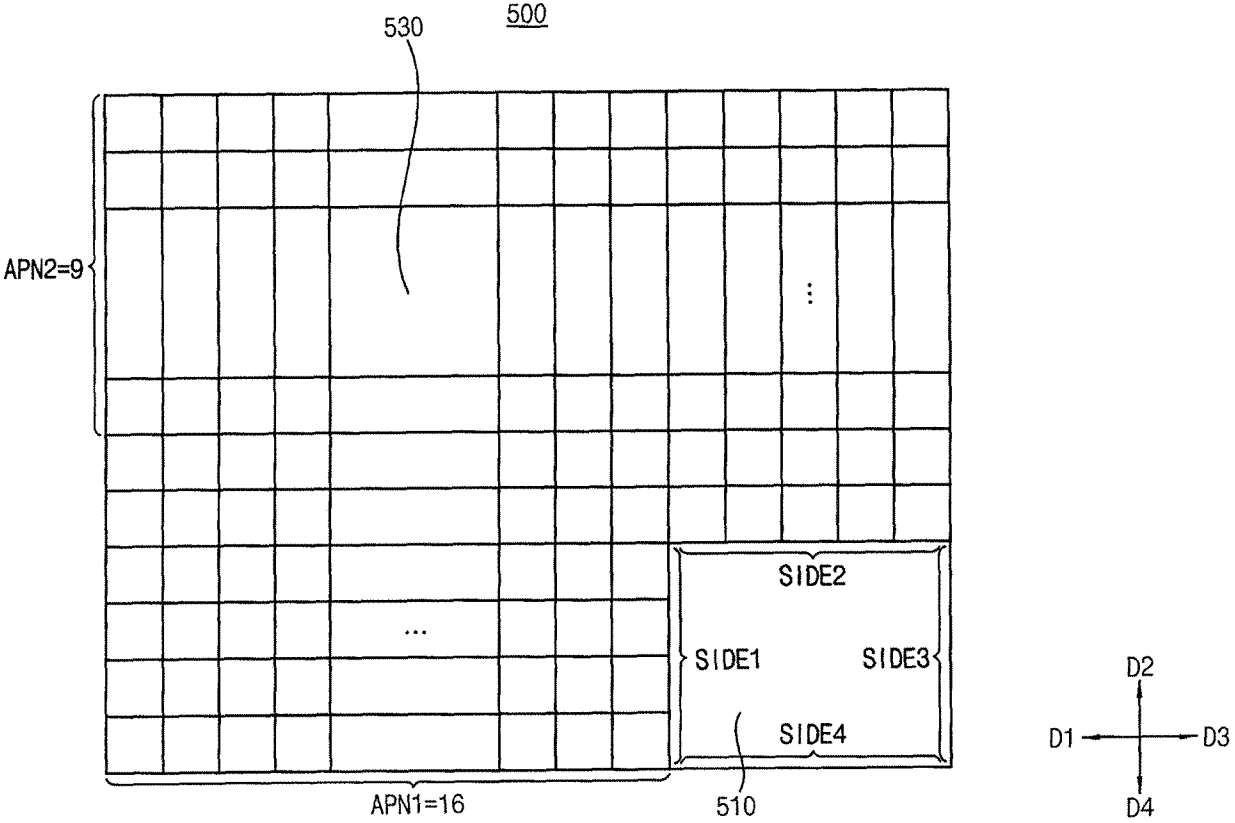

FIGS. 7 and 8 illustrate another example of a pixel array 500 in the display device of FIG. 1. Referring to FIGS. 7 and 8, the pixel array 500 may include the base pixels 510 and the addition pixels 530. The addition pixels 530 may be located in one side of a first side SIDE1 and a third side SIDE3 of the base pixels 510. The addition pixels 530 may be located in one side of a second side SIDE2 and a fourth side SIDE4 of the base pixels 510. For example, the addition pixels 530 may be located at the first side SIDE1 and the second side SIDE2 only. Also, the addition pixels 530 may be located at the third side SIDE3 and the fourth side SIDE4 only. Also, the addition pixels 530 may be located at the first side SIDE1 and the fourth side only. Also, the addition pixels 530 may be located at the second side SIDE2 and the third side SIDE3 only.

In one embodiment, in case the one side of the first side SIDE1 and the third side SIDE3 is the first side SIDE1 and the one side of the second side SIDE2 and the fourth side SIDE4 is the second side SIDE2, the proportion of a number APN1 of a first direction addition pixels and a number APN2 of a second direction addition pixels may be 16:9.

The number APN1 of the first direction addition pixels may be added to the first side SIDE1 according to a first direction D1. The number APN2 of the second direction addition pixels may be added to the second side SIDE2 according to a second direction D2. For example, the number APN1 of the first direction addition pixels may be 16. The number APN2 of the second direction addition pixels may be 9. The base pixels 510 may not be located in the center of the pixel array 500. The base pixels 510 may be located in edges of the pixel array 500. In case the one side of the first side SIDE1 and the third side SIDE3 is the first side SIDE1 and the one side of the second side SIDE2 and the fourth side SIDE4 is the second side SIDE2, the proportion of the number APN1 of the first direction addition pixels and the number APN2 of the second direction addition pixels may be 16:9.

In one embodiment, in case the one side of the first side SIDE1 and the third side SIDE3 is the third side SIDE3 and the one side of the second side SIDE2 and the fourth side SIDE4 is the fourth side SIDE4, the proportion of the number APN3 of the third direction addition pixels and the number APN4 of the fourth direction addition pixels may be 16:9. The number APN3 of the third direction addition pixels may be added to the third side SIDE3 according to a third direction D3. The number APN4 of the fourth direction addition pixels may be added to the fourth side SIDE4 according to a fourth direction D4. For example, the number APN3 of the third direction addition pixels may be 16. The number APN4 of the fourth direction addition pixels may be 9.

The base pixels 510 may not be located at the center of the pixel array 500. The base pixels 510 may be located at edges of the pixel array 500. In case the one side of the first side SIDE1 and the third side SIDE3 is the third side SIDE3 and the one side of the second side SIDE2 and the fourth side SIDE4 is the fourth side SIDE4, the proportion of the number APN3 of the third direction addition pixels and the number APN4 of the fourth direction addition pixels may be 16:9.

Figure 9:
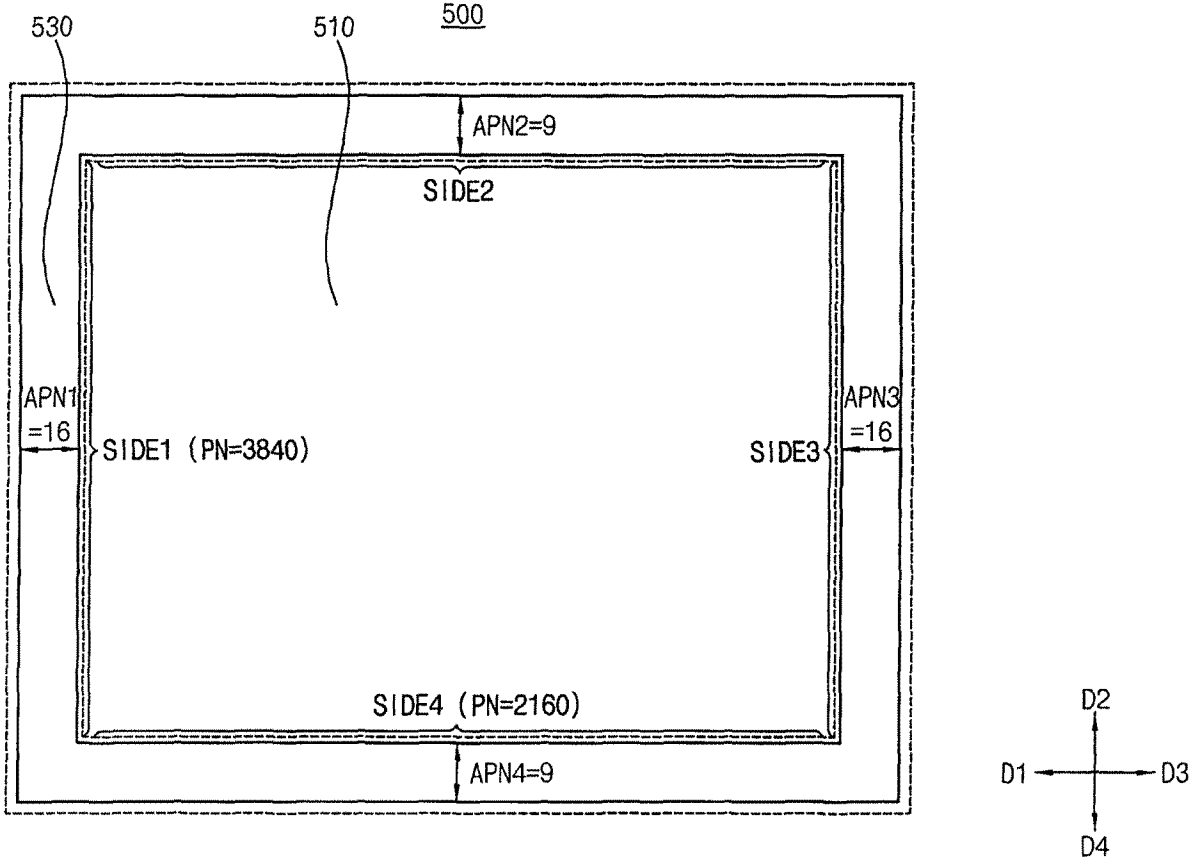
FIG. 9 illustrates an embodiment of base pixels and addition pixels.

FIG. 9 illustrates another embodiment of base pixels 510 and addition pixels in the display device of FIG. 1. Referring to FIG. 9, the pixel array 500 may include the base pixels 510 and the addition pixels 530. In FIGS. 7 and 8, the size of the base pixels 510 is illustrated to be very small for purposes of describing the addition pixels 530. However, actually, most of the pixel array 500 may be the base pixels 510. For example, the number of the base pixels 510 may be 3840*2160. The number APN1 of the first direction addition pixels may be 16 and the number APN2 of the second direction addition pixels may be 9. The number APN3 of the third direction addition pixels may be 16 and the number APN4 of the fourth direction addition pixels may be 9. Therefore, the number of the addition pixels 530 may be less than the number of base pixels 510.

Figure 10:
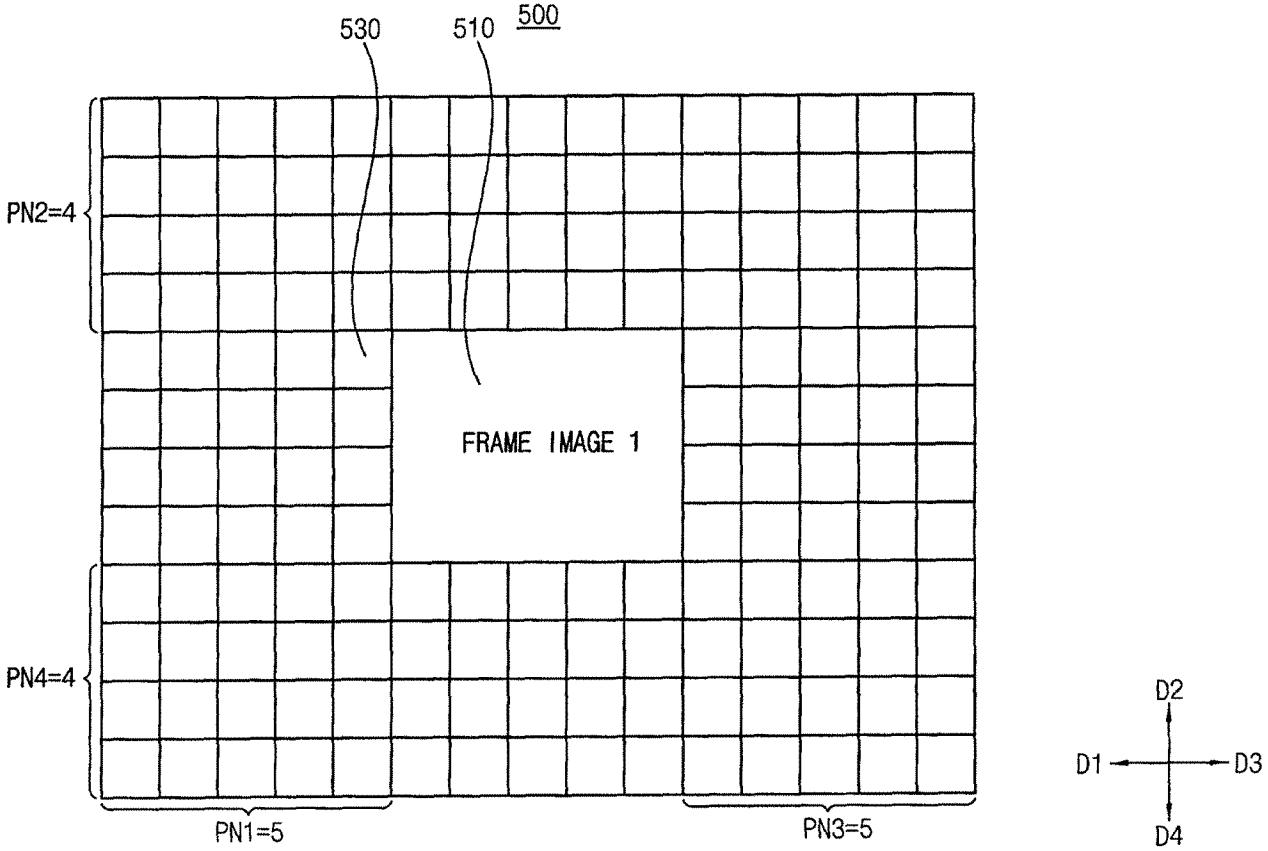
FIGS. 10 to 12 illustrate operation of the display device of FIG. 1 according to one embodiment.
Figure 11:
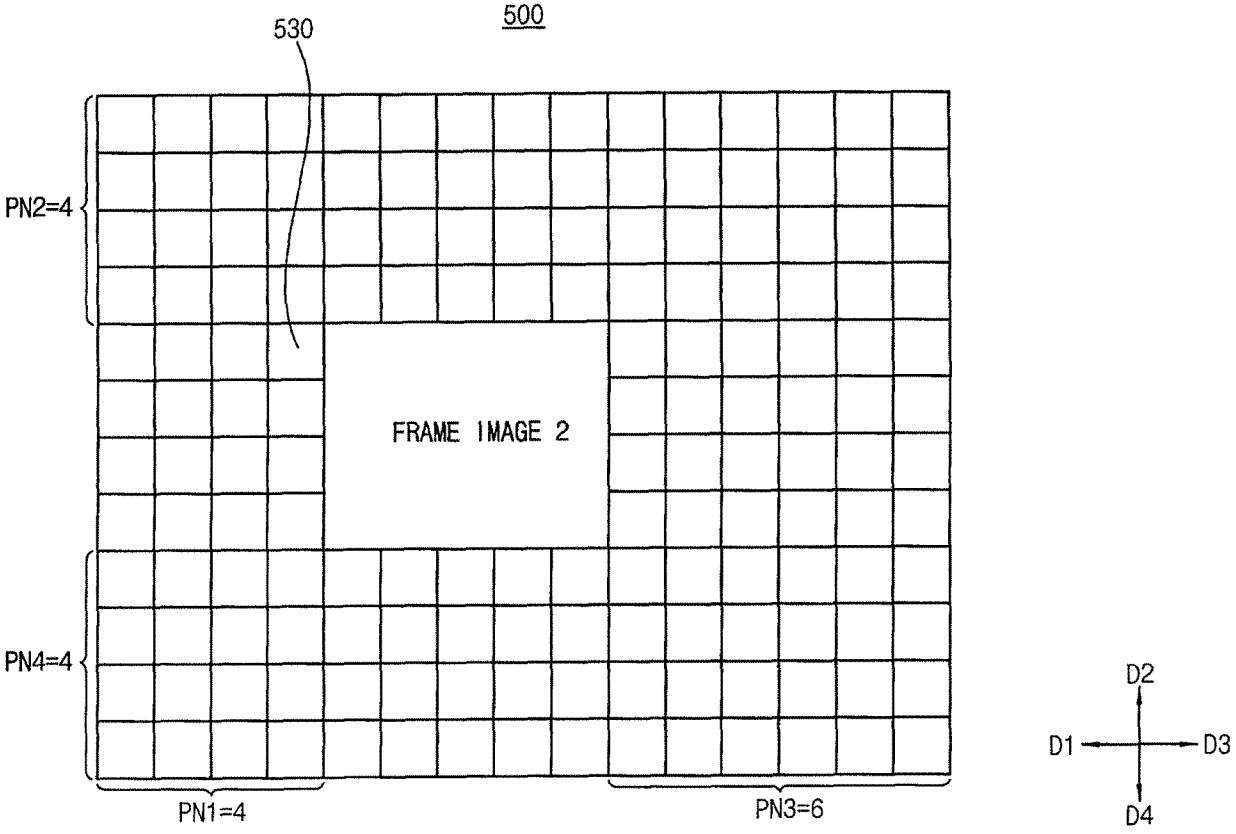
Figure 12:
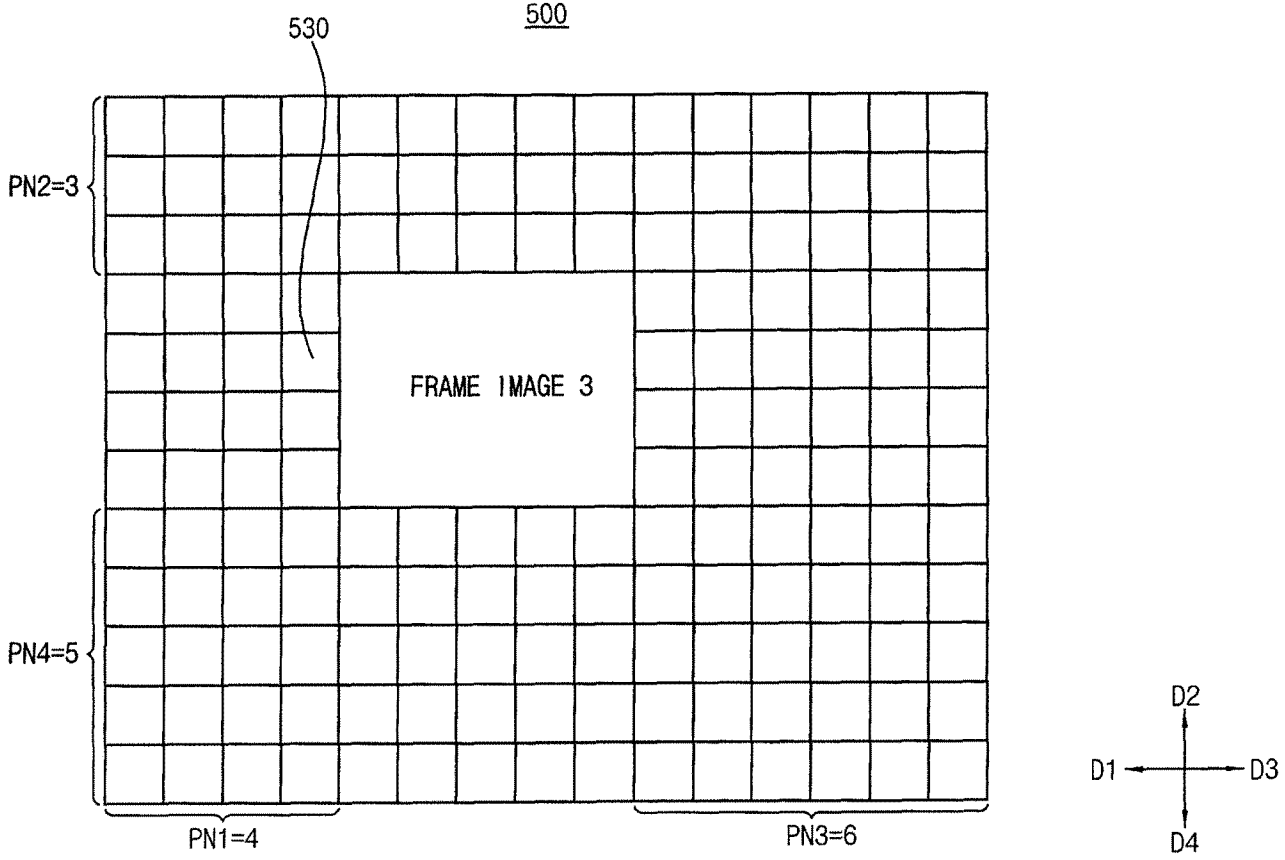

In one embodiment, the number of the addition pixels 530 may be less than 3% of the number of the base pixels 510. For example, the number of the base pixels 510 may be 3840*2160. A certain percentage (e.g., 3%) of the number of the base pixels 510 may be about 240000 pixels. Therefore, in case the number of the base pixels 510 is 3840*2160, the number of the addition pixels 530 may be less than 240000 pixels FIGS. 10 to 12 illustrate an embodiment for describing operation of the display device of FIG. 1. Referring to FIGS. 10 to 12, the pixel array 500 may include the base pixels 510 and the addition pixels 530. For example, the pixel array 500 may display the first frame image FI1 in the base pixels 510 based on the first position control signal PCS1. The first frame image FI1 may be generated based on the image signal IS and the image control signal ICS.

Thereafter, the pixel array 500 may display the second frame image FI2 in pixels that are one pixel-shifted from the base pixels 510 based on the second position control signal PCS2. The second frame image FI2 may be generated based on the image signal IS and the image control signal ICS.

Thereafter, the pixel array 500 may display the third frame image FI3 in pixels that are one pixel-shifted from the pixels where the second frame image FI2 is displayed based on the second position control signal PCS2. The third frame image FI3 may be generated based on the image signal IS and the image control signal ICS.

For example, the position information PI in the second position control signal PCS2 may be the first position information PI1. The first position information PI1 may indicate one pixel-shift according to the first direction D1. The pixel array 500 may display the second frame image FI2 in pixels that are one pixel-shifted from the base pixels 510 according to the first direction D1. In this case, the second frame image FI2 may be displayed in the base pixels 510 and the addition pixels 530. The position information PI in the third position control signal PCS3 may be the second position information PI2. The second position information PI2 may indicate one pixel-shift according to the second direction D2. The pixel array 500 may display the third frame image FI3 in pixels that are one pixel-shifted from the pixels that the second frame image FI2 is displayed according to the second direction D2. In this case, the third frame image FI3 may be displayed in the base pixels 510 and the addition pixels 530.

The pixel array 500 may display the frame image FI in a plurality of pixels included in the base pixels 510 and the addition pixels 530. The number of the plurality of pixels may correspond to a resolution of the frame image FI. A level value of pixels that do not display the frame image FI among the base pixels 510 and the addition pixels 530 may be one of a first level value and a second level value. For example, in FIG. 10, the level value of pixels that do not display the first frame image FI1 among the base pixels 510 and the addition pixels 530 may be one of the first level value and the second level value.

In one embodiment, the color corresponding to the first level value may be black and the color corresponding to the second level value may be gray. For example, in FIG. 10, the level value of pixels that do not display the first frame image FI1, among the base pixels 510 and the addition pixels 530, may be the first level value. In case the level value of pixels that do not display the first frame image FI1 is the first level value, the color corresponding to pixels that do not display the first frame image FI1 may be black. For example, in FIG. 10, the level value of pixels that do not display the first frame image FI1 among the base pixels 510 and the addition pixels 530 may be the second level value. In case the level value of pixels that do not display the first frame image FI1 is the second level value, the color corresponding to pixels that do not display the first frame image FI1 may be gray.

Figure 13:
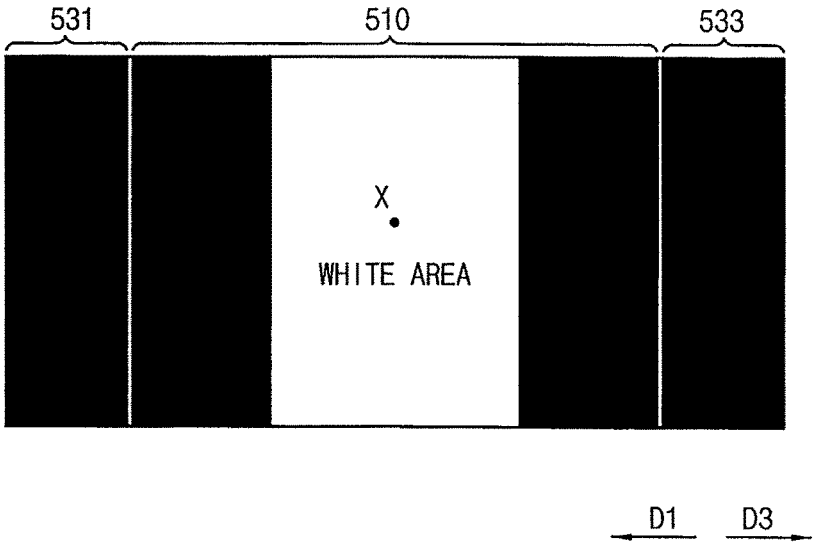
FIGS. 13 to 17 illustrate accumulation brightness based on background color according to one embodiment.
Figure 14:
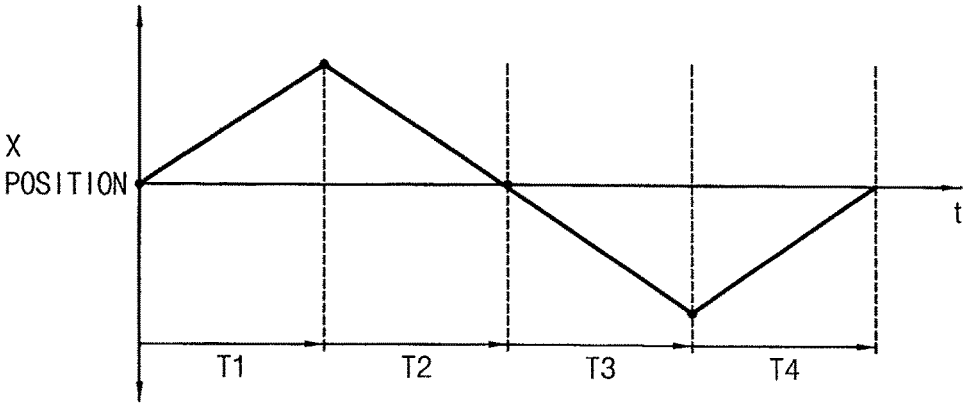

FIGS. 13 to 17 illustrate an embodiment for describing accumulation brightness according to background color. Referring to FIGS. 13 and 14, the pixel array 500 may include the base pixels 510 and the addition pixels 530. The addition pixels 530 may include the first addition pixels 530 and the second addition pixels 530. The white area may be moved according to the first direction D1 and the third direction D3.

During the first time interval, the white area may be moved according to the third direction D3. If the white area is moved according to the third direction D3 during the first time interval, an X position corresponding to the position on the x-axis may be increased.

During the second time interval, the white area may be moved according to the first direction D1. If the white area is moved according to the first direction D1 during the second time interval, the X position corresponding to the position on the x-axis may be decreased.

During the third time interval, the white area may be moved according to the first direction D1. If the white area is moved according to the first direction D1 during the third time interval, the X position corresponding to the position on the x-axis may be decreased more.

During the fourth time interval, the white area may be moved according to the third direction D3. If the white area is moved according to the third direction D3 during the fourth time interval, the X position corresponding to the position on the x-axis may be increased.

Figure 15:
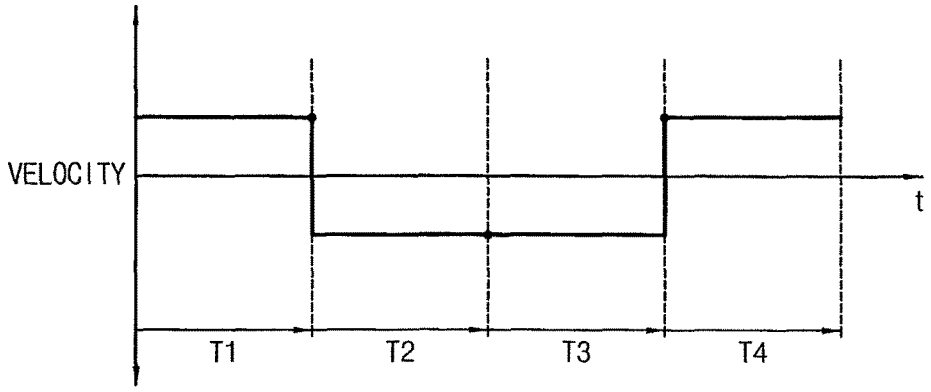

Referring to FIG. 15, the movement speed of the white area may be constant velocity. In case the white area is moved according to the third direction D3, the movement speed of the white area may be a positive number. In case the white area is moved according to the first direction D1, the movement speed of the white area may be a negative number. During the first time interval, the white area may be moved with a first velocity according to the third direction D3. During the second time interval, the white area may be moved with a second velocity according to the first direction D1. During the third time interval, the white area may be moved with the second velocity according to the first direction D1. During the fourth time interval, the white area may be moved with the first velocity according to the third direction D3. The first velocity may be the positive number and the second velocity may be the negative number.

Figure 16:
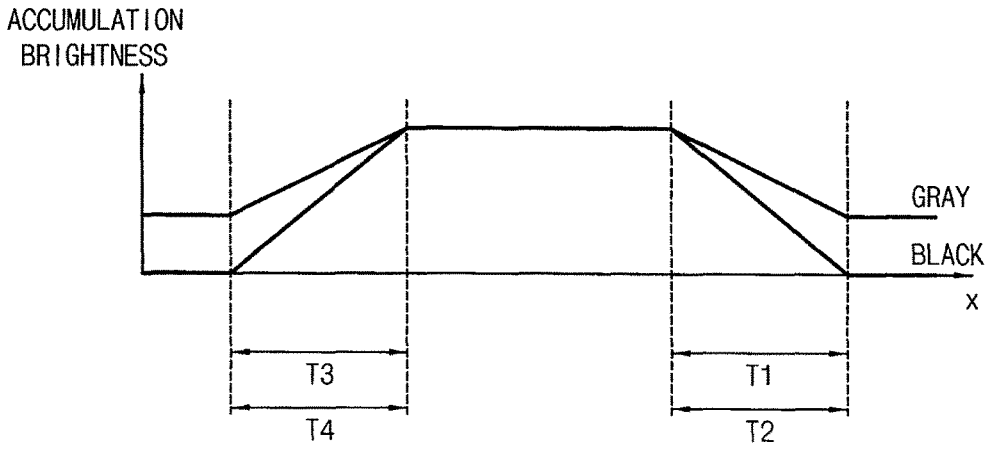
Figure 17:
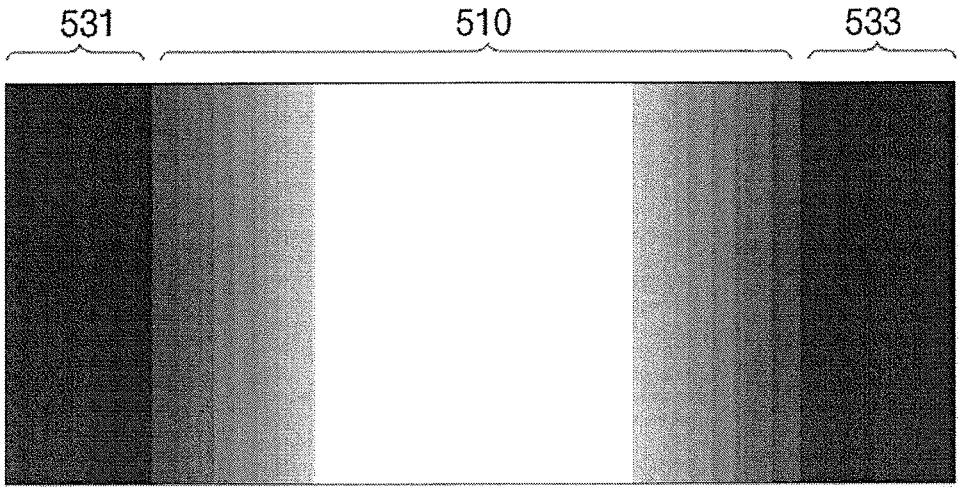

The accumulation brightness of pixels located according to the x-axis may be illustrated as in FIGS. 16 and 17. The level value of pixels that do not display the frame image FI among the base pixels 510 and the addition pixels 530 may be one of the first level value and the second level value. The color corresponding to the first level value may be black and the color corresponding to the second level value may be gray.

In case the level value of pixels that do not display the first frame image FI1 is the first level value corresponding to black, the deviation of the accumulation brightness between the pixels located in the center of the pixel array 500 and the pixels located at the edge of the pixel array 500 may be large.

In case the level value of pixels that do not display the first frame image FI1 is the second level value corresponding to gray, the deviation of the accumulation brightness between the pixels located at the center of the pixel array 500 and the pixels located at the edge of the pixel array 500 may be small. As the deviation of the accumulation brightness is increased, the boundary of the frame image FI may be distinct. Therefore, the level value of pixels that do not display the first frame image FI1 may be the second level value.

Figure 18:
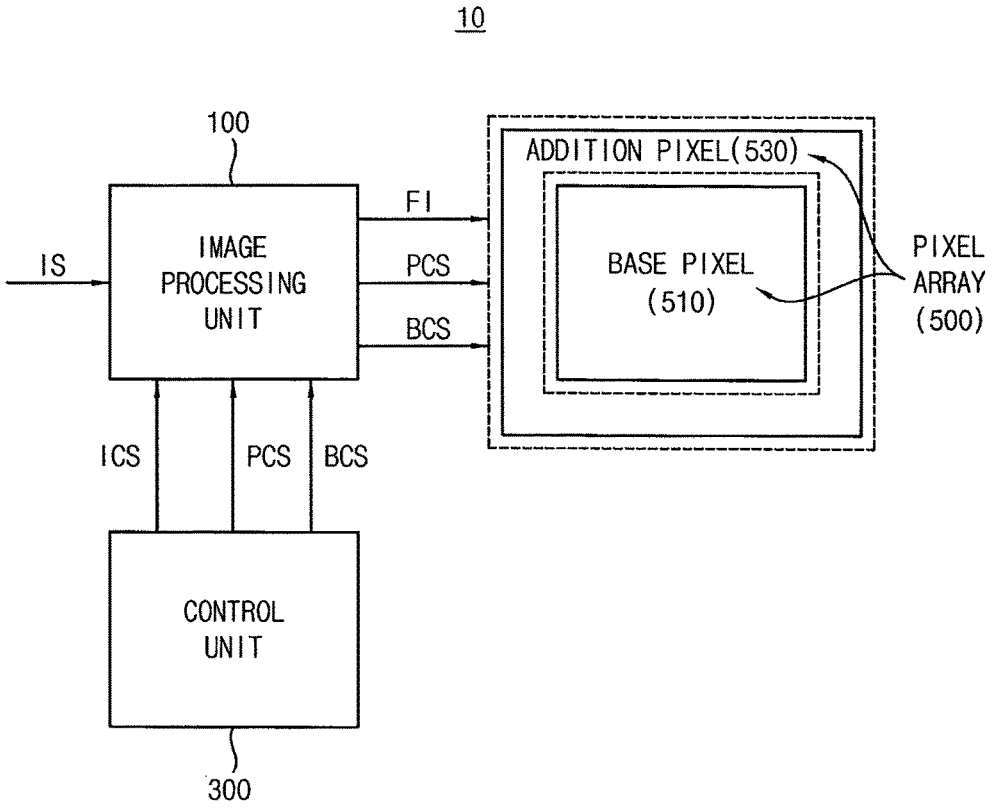
FIG. 18 illustrates another embodiment a display device.
Figure 19:
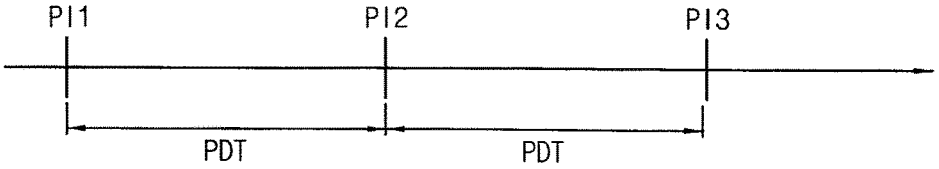
FIG. 19 illustrates position information changed every predetermined time interval according to one embodiment.

FIG. 18 illustrates another embodiment of a display device, and FIG. 19 illustrates an embodiment for describing position information that is changed every predetermined time interval.

Referring to FIGS. 18 and 19, a display device 10 includes a control unit 300, an image processing unit 100, and a pixel array 500. The control unit 300 generates an image control signal ICS and a position control signal PCS. The image processing unit 100 generates a frame image FI based on an image signal IS and the image control signal ICS. The image processing unit 100 provides the frame image FI and the position control signal PCS. The position control signal PCS includes position information PI where the frame image FI is located. The pixel array 500 includes base pixels 510 and addition pixels 530. The pixel array 500 displays the frame image FI in the base pixels 510 and the addition pixels 530 based on the position control signal PCS. The number of the base pixels 510 correspond to a resolution of the frame image FI. The addition pixels 530 are different from the base pixels 510.

In one embodiment, the control unit 300 may generate a background control signal BCS. The image processing unit 100 may output the background control signal BCS, the frame image FI, and the position control signal PCS. The pixel array 500 may select the one of the first level value or the second level value as the level value of pixels that do not display the frame image FI, among the base pixels 510 and the addition pixels 530, based on the background control signal BCS.

In one embodiment, the position information PI may be changed based on a predetermined time interval PDT. For example, the control unit 300 may provide the first position control signal PCS1 including the first position information PI1. After the predetermined time interval PDT, the control unit 300 may provide the second position control signal PCS2 including the second position information PI2. After another predetermined time interval PDT, the control unit 300 may provide the third position control signal PCS3 including the third position information PI3. Therefore, the position information PI may be changed based on the predetermined time interval PDT. For example, the predetermined time interval PDT may be less than three seconds.

Figure 20:
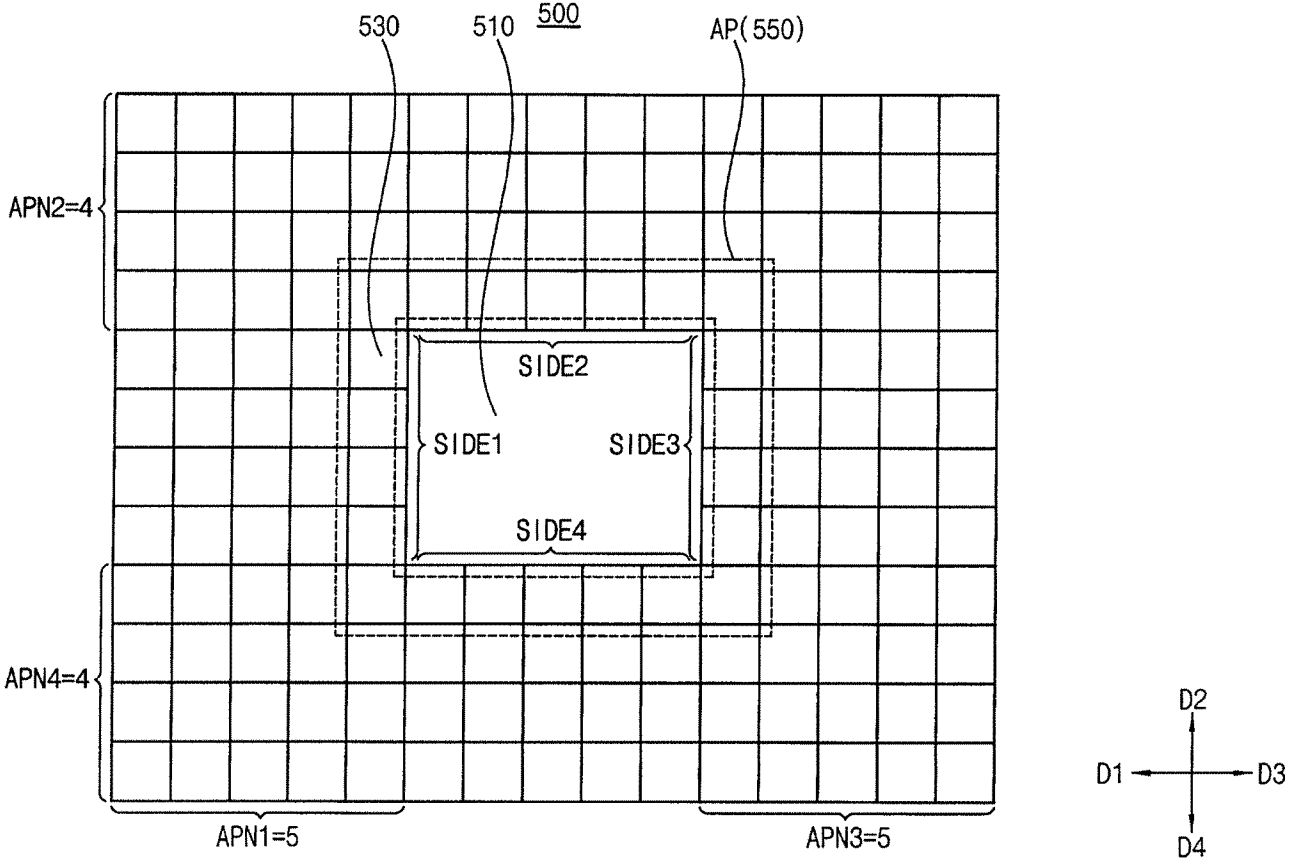
FIG. 20 illustrates a region where a frame image is displayed based on position information according to one embodiment.

FIG. 20 illustrates an embodiment for describing region where a frame image is displayed according to position information. Referring to FIGS. 18 and 20, the pixel array 500 may include the base pixels 510 and the addition pixels 530. In case the control unit 300 provides a first position control signal PCS1, and provides a second control signal after the predetermined time interval PDT, the second position information PI2 in the second position control signal PCS2 may be the information corresponding to an adjacent pixel 550 of a pixel indicated by the first position information PI1 in the first position control signal PCS1.

For example, the second position information may indicate one pixel-shift according to the first direction D1 from the pixels where the first frame image FI1 is displayed based on the first position control signal PCS1. Also, the second position information may indicate one pixel-shift according to the second direction D2 from the pixels where the first frame image FI1 is displayed based on the first position control signal PCS1. Also, the second position information may indicate one pixel-shift according to the third direction D3 from the pixels where the first frame image FI1 is displayed based on the first position control signal PCS1. Also, the second position information may indicate one pixel-shift according to the fourth direction D4 from the pixels where the first frame image FI1 is displayed based on the first position control signal PCS1.

Figure 21:
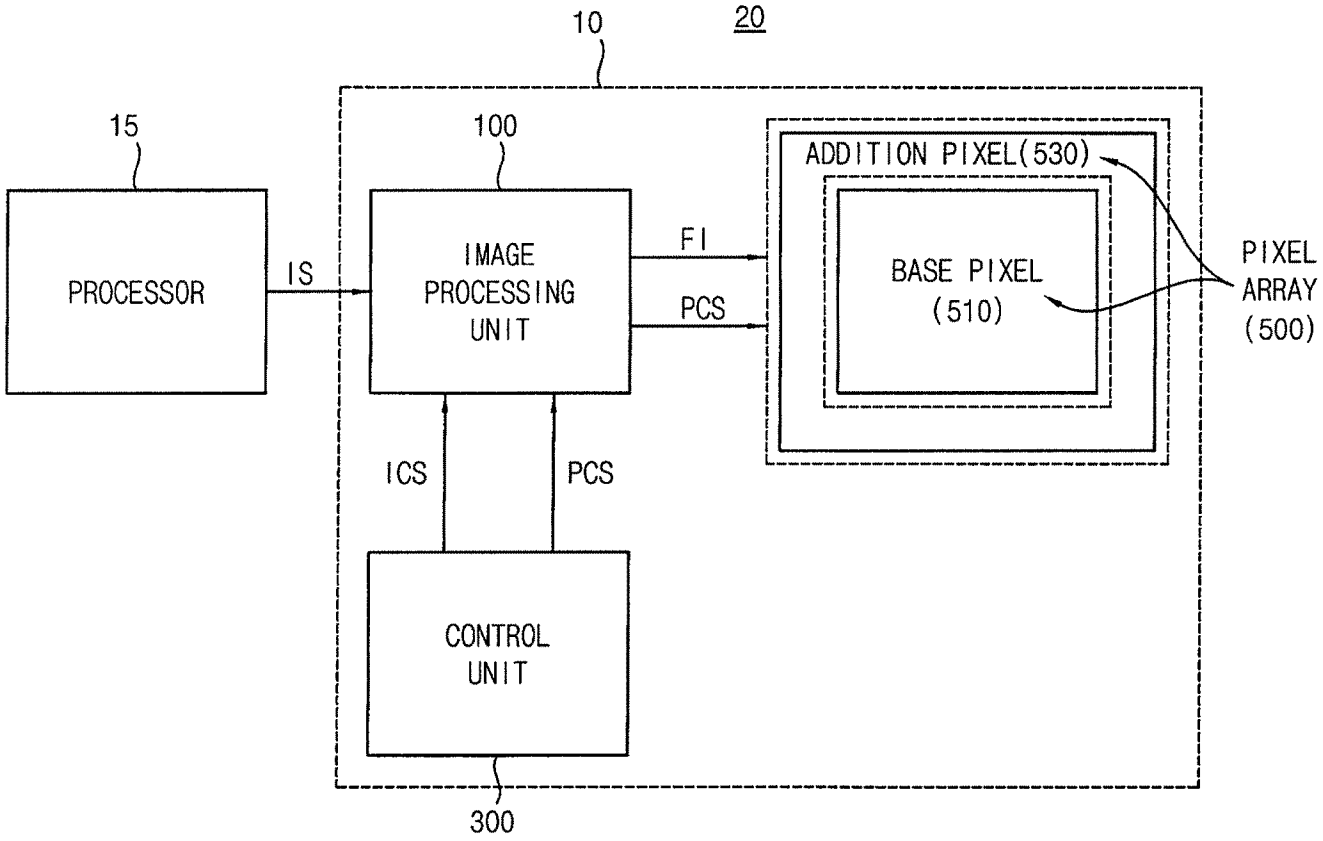
FIG. 21 illustrates an embodiment of a display system.

FIG. 21 illustrates an embodiment of a display system 20 which includes a processor 15 and a display device 10. The processor 15 provides an image signal IS. The display device 10 displays a frame image FI that is generated based on the image signal IS. The display device 10 includes a control unit 300, an image processing unit 100, and a pixel array 500. The control unit 300 generates an image control signal ICS and a position control signal PCS. The image control signal ICS may be used to compose a frame image FI from an image signal IS. The position control signal PCS may be used to determine position where the frame image FI is displayed in the pixel array 500.

The image processing unit 100 generates a frame image FI based on an image signal IS and the image control signal ICS. The image processing unit 100 provides the frame image FI and the position control signal PCS. The position control signal PCS includes position information PI where the frame image FI is located. For example, in a first time, the image processing unit 100 may provide the first frame image FI1 and the first position control signal PCS1 to the pixel array 500. The first frame image FI1 may be generated based on the image signal IS and the image control signal ICS. The first position control signal PCS1 may include the position information PI where the first frame image FI1 is located.

In a second time after the first time, the image processing unit 100 may provide the second frame image FI2 and the second position control signal PCS2 to the pixel array 500. The second frame image FI2 may be generated based on the image signal IS and the image control signal ICS. The second position control signal PCS2 may include the position information PI where the second frame image FI2 is located. A pixel corresponding to the position information PI included in the second position control signal PCS2 may be an adjacent pixel 550 to a pixel corresponding to the position information PI included in the first position control signal PCS1

A pixel array 500 includes base pixels 510 and addition pixels 530. A pixel array 500 displays the frame image FI in the base pixels 510 and the addition pixels 530 based on the position control signal PCS. The number of the base pixels 510 correspond to a resolution of the frame image FI. The addition pixels 530 are different from the base pixels 510. For example, the resolution of the frame image FI may be 3840*2160. In this case, the number of the base pixels 510 may be 3840*2160. The addition pixels 530 are different from the base pixels 510. The addition pixels 530 may be located at one or more sides of the base pixels 510. In one embodiment, the addition pixels 530 are located at first to fourth sides SIDE1 to SIDE4 of the base pixels 510.

In one embodiment, the position information PI may be changed every predetermined time interval PDT. The control unit 300 may provide the position control signal PCS to the image processing unit 100 the every predetermined time interval PDT. Also, in one embodiment, in case the position information PI in the position control signal PCS is changed, the location where the frame image FI is displayed in the pixel array 500 is changed.

Figure 22:
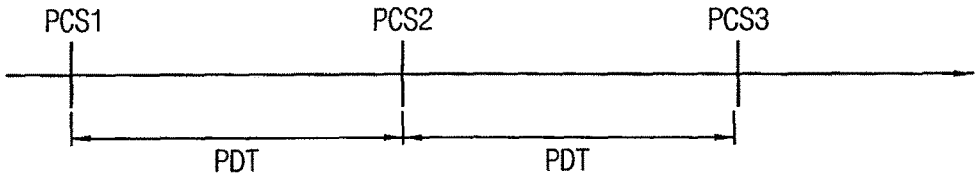
FIG. 22 illustrates a position control signal changed every predetermined time interval according to one embodiment.

FIG. 22 illustrates an embodiment for describing a position control signal that is changed every predetermined time interval. Referring to FIGS. 2 and 21, the addition pixels 530 may be located at one or more sides of the base pixels 510, e.g., at first to fourth sides SIDE1 to SIDE4 of the base pixels 510. The number APN1 of the first direction addition pixels added to the first side SIDE1 according to the first direction D1 may be equal to the number APN3 of the third direction addition pixels added to the third side SIDE3 according to the third direction D3. The number APN2 of the second direction addition pixels added to the second side SIDE2 according to the second direction D2 may be equal to the number APN4 of the fourth direction addition pixels added to the fourth side SIDE4 according to the fourth direction D4.

For example, the number APN1 of the first direction addition pixels added to the first side SIDE1 according to the first direction D1 may be 5. The number APN3 of the third direction addition pixels added to the third side SIDE3 according to the third direction D3 may be 5. In this case, the number APN1 of the first direction addition pixels and the number APN3 of the third direction addition pixels may be the same number 5. The number APN2 of the second direction addition pixels added to the second side SIDE2 according to the second direction D2 may be 4. The number APN4 of the fourth direction addition pixels added to the fourth side SIDE4 according to the fourth direction D4 may be 4. In this case, the number APN2 of the second direction addition pixels and the number APN4 of the fourth direction addition pixels may be the same number 4.

In case the addition pixels 530 are located in the first to fourth sides SIDE1 to SIDE4 of the base pixels 510, the number APN1 of the first direction addition pixels and the number APN3 of the third direction addition pixels may be equal. The number APN2 of the second direction addition pixels and the number APN4 of the fourth direction addition pixels may be equal.

In accordance with the present embodiment, changing the position where the frame image FI is displayed using the addition pixels 530 in the display device 10 reduces or prevents distortion of the frame image FI because the resolution of the frame image FI is maintained. Also, changing the position where the frame image FI is displayed using the addition pixels 530 may reduce or prevent an after-image effect.

Figure 23:
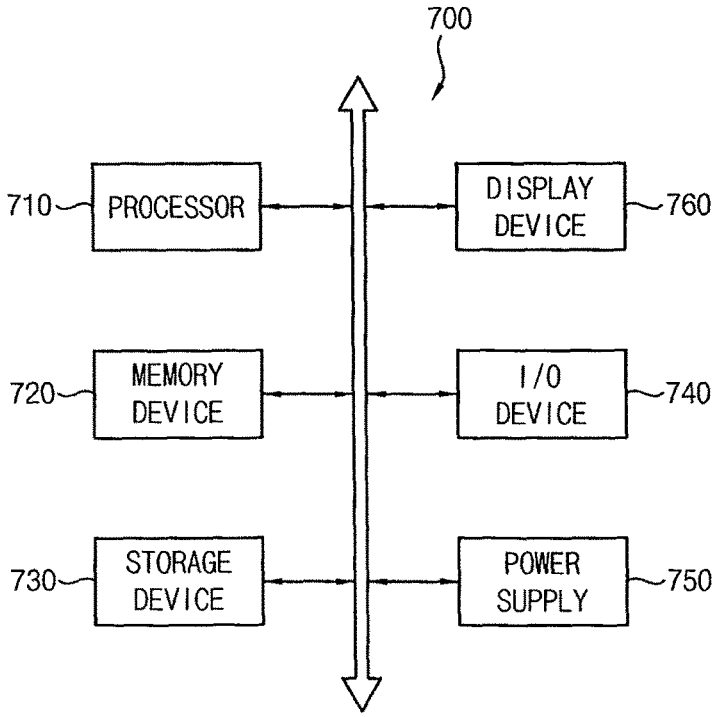
FIG. 23 illustrates an embodiment of a mobile device.

FIG. 23 illustrates an embodiment of a mobile device 700 which includes a processor 710, a memory device 720, a storage device 730, an input/output (I/O) device 740, a power supply 750, and an electroluminescent display device 760. The mobile device 700 may further include a plurality of ports for communicating a video card, a sound card, a memory card, a universal serial bus (USB) device, or other electronic systems.

The processor 710 may perform various computing functions or tasks. The processor 710 may be for example, a microprocessor, a central processing unit (CPU), etc. The processor 710 may be connected to other components via an address bus, a control bus, a data bus, etc. Further, the processor 710 may be coupled to an extended bus such as a peripheral component interconnection (PCI) bus.

The memory device 720 may store data for operations of the mobile device 700. For example, the memory device 720 may include at least one non-volatile memory device such as an erasable programmable read-only memory (EPROM)

device, an electrically erasable programmable read-only memory (EEPROM) device, a flash memory device, a phase change random access memory (PRAM) device, a resistance random access memory (RRAM) device, a nano-floating gate memory (NFGM) device, a polymer random access memory (PoRAM) device, a magnetic random access memory (MRAM) device, a ferroelectric random access memory (FRAM) device, and/or at least one volatile memory device such as a dynamic random access memory (DRAM) device, a static random access memory (SRAM) device, a mobile dynamic random access memory (mobile DRAM) device, etc.

The storage device 730 may be, for example, a solid state drive (SSD) device, a hard disk drive (HDD) device, a CD-ROM device, etc. The I/O device 740 may be, for example, an input device such as a keyboard, a keypad, a mouse, a touch screen, and/or an output device such as a printer, a speaker, etc. The power supply 750 may supply power for operating the mobile device 700. The electroluminescent display device 760 may communicate with other components via the buses or other communication links.

The embodiments described herein may be applied to any mobile device or any computing device. For example, the embodiments described herein may be applied to a cellular phone, a smart phone, a tablet computer, a personal digital assistant (PDA), a portable multimedia player (PMP), a digital camera, a music player, a portable game console, a navigation system, a video phone, a personal computer (PC), a server computer, a workstation, a tablet computer, or a laptop computer.

The methods, processes, and/or operations described herein may be performed by code or instructions to be executed by a computer, processor, controller, or other signal processing device. The computer, processor, controller, or other signal processing device may be those described herein or one in addition to the elements described herein. Because the algorithms that form the basis of the methods (or operations of the computer, processor, controller, or other signal processing device) are described in detail, the code or instructions for implementing the operations of the method embodiments may transform the computer, processor, controller, or other signal processing device into a special-purpose processor for performing the methods described herein.

Also, another embodiment may include a computer-readable medium, e.g., a non-transitory computer-readable medium, for storing the code or instructions described above. The computer-readable medium may be a volatile or non-volatile memory or other storage device, which may be removably or fixedly coupled to the computer, processor, controller, or other signal processing device which is to execute the code or instructions for performing the method embodiments described herein.

Example embodiments have been disclosed herein, and although specific terms are employed, they are used and are to be interpreted in a generic and descriptive sense only and not for purpose of limitation. In some instances, as would be apparent to one of skill in the art as of the filing of the present application, features, characteristics, and/or elements described in connection with a particular embodiment may be used singly or in combination with features, characteristics, and/or elements described in connection with other embodiments unless otherwise indicated. Accordingly, it will be understood by those of skill in the art that various changes in form and details may be made without departing from the spirit and scope of the present invention as set forth in the following claims.

What is claimed is:

1. A display device, comprising:

a controller to generate an image control signal and a position control signal;

an image processor to generate a frame image based on an image signal and the image control signal, and to provide the frame image and the position control signal, the position control signal including a position information where the frame image is located; and a pixel array including base pixels and addition pixels, the pixel array to display the frame image in the base pixels and the addition pixels based on the position control signal to change where the frame image is displayed or to extend the frame image while maintaining a proportion of the frame image, wherein a number of the base pixels corresponds to a resolution of the frame image, wherein the addition pixels are different from the base pixels, and wherein the pixel array displays the frame image in a plurality of pixels in the base pixels and the addition pixels, a number of the plurality of pixels corresponding to a resolution of the frame image, and wherein a level value of pixels that do not display the frame image among the base pixels and the addition pixels is one of a first level value or a second level value.

2. The display device as claimed in claim 1, wherein the addition pixels are at first to fourth sides of the base pixels.

3. The display device as claimed in claim 2, wherein:

a number of first direction addition pixels added to the first side according to a first direction is equal to a number of a third direction addition pixels added to the third side according to a third direction, and a number of a second direction addition pixels added to the second side according to a second direction is equal to a number of a fourth direction addition pixels added to the fourth side according to a fourth direction.

4. The display device as claimed in claim 3, wherein the proportion-corresponds to a proportion of the number of the first direction addition pixels and the number of the second direction addition pixels is 16:9.

5. The display device as claimed in claim 2, wherein:

a number of a first direction addition pixels added to the first side according to a first direction is different from a number of a third direction addition pixels added to the third side according to a third direction, and a number of a second direction addition pixels added to the second side according to a second direction is different from a number of a fourth direction addition pixels added to the fourth side according to a fourth direction.

6. The display device as claimed in claim 5, wherein:

the proportion corresponds to a proportion of a first addition pixel sum and a second addition pixel sum is 16:9, the first addition pixel sum is a sum of the number of the first direction addition pixels and the number of the third direction addition pixels, and the second addition pixel sum is a sum of the number of the second direction addition pixels and the number of the fourth direction addition pixels.

7. The display device as claimed in claim 1, wherein:

the addition pixels are at one side of a first side or a third side of the base pixels, and the addition pixels are at one side of a second side or a fourth side of the base pixels.

8. The display device as claimed in claim 7, wherein:

when the addition pixels are at the first side and the second side, the proportion corresponds to a proportion of a number of a first direction addition pixels and a number of a second direction addition pixels is 16:9, the number of first direction addition pixels are added to the first side according to a first direction, and the number of a second direction addition pixels are added to the second side according to a second direction.

9. The display device as claimed in claim 1, wherein a number of the addition pixels is less than a number of the base pixels.

10. The display device as claimed in claim 9, wherein the number of the addition pixels is less than 3% of the number of the base pixels.

11. The display device as claimed in claim 1, wherein:

a color corresponding to the first level value is black, and a color corresponding to the second level value is gray.

12. The display device as claimed in claim 11, wherein:

the controller is to generate a background control signal, the image processor is to output the background control signal, the frame image, and the position control signal, and the pixel array is to select one of the first level value or the second level value as the level value of pixels that do not display the frame image, among the base pixels and the addition pixels, based on the background control signal.

13. The display device as claimed in claim 1, wherein the position information is changed based on a predetermined time interval.

14. The display device as claimed in claim 13, wherein the predetermined time interval is less than three seconds.

15. The display device as claimed in claim 14, wherein:

when the controller provides a first position control signal and provides a second position control signal after the predetermined time interval, second position information in the second position control signal includes information corresponding to an adjacent pixel of a pixel indicated by a first position information in the first position control signal.

16. A display system, comprising:

a processor to provide an image signal; and a display device to display a frame image generated based on the image signal, the display device including:

a controller to generate an image control signal and a position control signal;

an image processor to generate a frame image based on an image signal and the image control signal, and to provide the frame image and the position control signal, the position control signal including position information where the frame image is located; and a pixel array including base pixels and addition pixels, the pixel array to display the frame image in the base pixels and the addition pixels based on the position control signal to change where the frame image is displayed or to extend the frame image while maintaining a proportion of the frame image, wherein a number of the base pixels corresponds to a resolution of the frame image, wherein the addition pixels are different from the base pixels, and wherein:

the addition pixels are at first to fourth sides of the base pixels, a number of a first direction addition pixels added to the first side according to a first direction is equal to a number of a third direction addition pixels added to the third side according to a third direction, and a number of a second direction addition pixels added to the second side according to a second direction is equal to a number of a fourth direction addition pixels added to the fourth side according to a fourth direction.

17. The display system as claimed in claim 16, wherein:

the position information is changed every predetermined time interval, and the controller is to provide the position control signal to the image processor the every predetermined time interval.

18. The display system as claimed in claim 17, wherein:

when the position information in the position control signal is changed, a location where the frame image is displayed in the pixel array is changed.

19. A display device, comprising:

a controller to generate an image control signal and a position control signal;

an image processor to generate a frame image based on an image signal and the image control signal, and to provide the frame image and the position control signal, the position control signal including a position information where the frame image is located; and a pixel array including base pixels and addition pixels, the pixel array to display the frame image in the base pixels and the addition pixels based on the position control signal to change where the frame image is displayed or to extend the frame image while maintaining a proportion of the frame image, wherein a number of the base pixels corresponds to a resolution of the frame image, wherein the addition pixels are different from the base pixels, wherein the addition pixels are at first to fourth sides of the base pixels, wherein a number of a first direction addition pixels added to the first side according to a first direction is different from a number of a third direction addition pixels added to the third side according to a third direction, and wherein a number of a second direction addition pixels added to the second side according to a second direction is different from a number of a fourth direction addition pixels added to the fourth side according to a fourth direction.

* * * * *